United States Patent [19]

Choulet et al.

[11] 4,187,102

[45] Feb. 5, 1980

[54] METHOD FOR CONTROLLING THE TEMPERATURE OF THE MELT DURING PNEUMATIC REFINING OF STEEL

[75] Inventors: Richard J. Choulet, Phoenix, Ariz.; Stewart K. Mehlman, Tarrytown, N.Y.

[73] Assignee: Union Carbide Corporation, New York, N.Y.

[21] Appl. No.: 936,397

[22] Filed: Aug. 24, 1978

[51] Int. Cl.[2] ..... C21C 5/34

[52] U.S. Cl. ..... 75/60; 75/52

[58] Field of Search ..... 75/60, 52

[56] References Cited

U.S. PATENT DOCUMENTS

| | | | |
|---|---|---|---|
| 2,546,340 | 3/1951 | Hilty | 75/130.5 |
| 3,323,907 | 6/1967 | Kurzinski | 75/52 |
| 3,607,247 | 9/1971 | McCoy | 75/52 |

*Primary Examiner*—P. D. Rosenberg

*Attorney, Agent, or Firm*—Lawrence G. Kastriner

[57] ABSTRACT

The method enables the desired tap temperature to be obtained during subsurface pneumatic refining of carbon steel or low alloy steel, without the need to reblow the heat, by adding to the melt, before starting the injection of refining oxygen, a fast oxidizing element such as aluminum, and a slow oxidizing element, such as silicon. The amount of fast oxidizing element added is such that the total amount thereof in the melt is sufficient, when oxidized, to raise the temperature of the melt to the desired temperature before substantial decarburization begins, and the amount of slow oxidizing element added is such that the total amount thereof is sufficient, when oxidized, to maintain the temperature of the melt within the desired temperature range during the decarburization period.

9 Claims, 1 Drawing Figure

METHOD FOR CONTROLLING THE TEMPERATURE OF THE MELT DURING PNEUMATIC REFINING OF STEEL

BACKGROUND

This application relates in general to the refining of steel, and more particularly to the surface pneumatic refining of carbon or low alloy steels wherein the temperature of the melt is controlled during refining in order that the desired tap temperature be obtained at the end of the refining period.

Several subsurface pneumatic steel refining processes are known in the art including, for example, the AOD, CLU, OBM, Q-BOP and the LWS processes. U.S. patents illustrative of these processes, respectively, are: U.S. Pat. Nos. 3,252,790, 3,867,135, 3,706,549, 3,930,843 and 3,844,768.

The term "subsurface pneumatic refining" as used in the present specification and claims is intended to mean a process wherein decarburization of the melt is achieved by the subsurface injection of oxygen gas, alone or in combination with one or more gases selected from the group consisting of argon, nitrogen, ammonia, steam, carbon dioxide, hydrogen methane or higher hydrocarbon gas. The gases may be blown in by following various blowing programs depending on the grade of steel made and on the specific gases used in combination with oxygen. In addition to decarburization, subsurface pneumatic refining may also cause the melt to become desulfurized, dephosphorized and degassed. Furthermore, the refining period may end with certain finishing steps, such as lime and alloy additions to reduce the oxidized alloying elements and form a basic slag, and addition of alloying elements to adjust the melt composition to meet melt specifications.

The melt is heated by the exothermic oxidation reactions which take place during the decarburization stage of the refining period, while the melt cools quite rapidly during the finishing stage since the additions of lime and alloying elements are endothermic, as well as the fact that no exothermic reactions are taking place.

Subsurface pneumatic refining, commonly referred to in the art as "blowing", normally produces one or more of the following results: decarburization, deoxidation, desulfurization, and degassing of the heat. In order to obtain these results it is necessary to provide sufficient oxygen to burn out the carbon to the desired level (decarburization), sufficient sparging gas to thoroughly mix the deoxidizing additions into the melt and to achieve good slag-metal interaction (deoxidation), to obtain a basic slag (for desulfurization), and sufficient sparging gas to assure that low levels of hydrogen and nitrogen will be obtained in the melt (degassing).

Pneumatic refining has two opposing temperature constraints. One is that a sufficiently high temperature must be obtained by the exothermic reactions to permit the endothermic steps to be carried out while maintaining the temperature of the melt sufficiently high for tapping of the heat. The opposing restraint is that the peak temperature attained in the refining vessel must be held below one that will cause excessive deterioration of the refractory lining of the vessel.

All of the above-mentioned surface pneumatic refining processes suffer from the common difficulty of achieving complete refining of the melt while maintaining a sufficiently high temperature to permit tapping of the heat at the end of the refining period. In order to overcome this problem, it is common practice in the art to reblow the heat with oxygen, thereby generating heat by the exothermic oxidation of carbon and metallic elements in the melt.

Although the present invention is applicable to all of the above-mentioned subsurface pneumatic steel refining processes, for purposes of convenience, the invention will be described and illustrated by reference to the argon-oxygen decarburization (AOD) process.

The basic AOD refining process is disclosed by Krivsky in U.S. Pat. No. 3,752,790. An improvement on Krivsky relating to the programmed blowing of the gases is disclosed by Nelson et al in U.S. Pat. No. 3,046,107. The use of nitrogen in combination with argon and oxygen to achieve predetermined nitrogen contents is disclosed by Saccomano et al in U.S. Pat. No. 3,754,894. A modification of the AOD process is also shown by Johnsson et al in U.S. Pat. No. 3,867,135 which utilizes steam or ammonia in combination with oxygen to refine molten metal.

By use of the term "argon-oxygen decarburization or AOD process" in the present specification and claims is meant, a process for refining molten metals and alloys contained in a refining vessel provided with at least one submerged tuyere, comprising (a) injecting into the melt through said tuyere(s) an oxygen-containing gas containing up to 90% of a dilution gas, said dilution gas functioning to reduce the partial pressure of the carbon monoxide in the gas bubbles formed during decarburization of the melt and/or to alter the feed rate of oxygen to the melt without substantially altering the total injected gas flow rate, and thereafter (b) injecting a sparging gas into the melt through said tuyere(s) said sparging gas functioning to remove impurities from the melt by degassing, deoxidation, volatilization, or by flotation of said impurities with subsequent entrapment or reaction with the slag. Optionally, said process may have the oxygen-containing gas stream surrounded by an annular stream of a protective fluid which functions to protect the tuyere(s) and the surrounding refractory lining from excessive wear. The useful dilution gases include argon, helium, hydrogen, nitrogen, carbon monoxide, carbon dioxide, steam or a hydrocarbon gas; argon is preferred. Useful sparging gases include argon, helium, nitrogen and steam; argon being preferred. Useful protective fluids include argon, helium, hydrogen, nitrogen, carbon monoxide, carbon dioxide, steam or a hydrocarbon fluid; argon again is preferred.

During the refining period the temperature of the melt is influenced by those factors that constitute heat losses and those that constitute heat gains. In the refining vessel heat is required to:

(1) raise the temperature of the melt from its charge temperature to its tap temperature, (2) dissolve the lime, as well as any alloy, scrap or other additions made during refining, (3) make up for the heat lost by the melt to its surroundings during the overall refining period (i.e. during inert gas stirring, blowing, reduction and turn downs).

Heat is supplied during the refining period only by the exothermic reactions which take place during refining. These include the oxidation of the carbon (decarburization), silicon and other metallic constituents in the melt (such as iron, chrome, manganese, etc.).

When a heat of steel is refined in a relatively large vessel the heat lost per ton of melt is relatively small. Consequently, the heat gained from the exothermic oxidations of carbon, metallics and silicon tends to balance the heat lost. However, when steel is refined in a small vessel, the magnitude of the heat loss per ton of melt can be so great that the heat produced by oxidation will not balance the heat lost. This results in refined heats whose temperature is below the desired tapping temperature. This problem has been commonly overcome by the prior art by reblowing the heat with an oxygen containing gas to generate more heat and hence to raise the temperature of the melt to the desired tapping temperature. Such reblowing is, however, undesirable because it takes additional time, requires the use of additional oxygen and causes undesirable oxidation of metallic elements in the melt, producing inefficiency in the overall refining operation, and adversely affect the quality of the metal.

It would appear possible at first glance to solve the low tapping temperature problem by increasing the magnitudes of the heat gain factors and/or to decrease the mangitudes of the heat loss factors mentioned above as contributing to the overall heat balance. However, closer examination of this problem will show that this is not practical for small vessels.

If carbon were to be added in order to increase the amount available for oxidation, at constant oxygen blowing rates the heat losses would also increase. In fact, the net effect of oxidizing additional carbon is either no heat gain or a heat loss. Since it is undesirable to lose the metallic elements from the heat, an increase in metallic oxidation is likewise undesirable. Moreover, a sufficient increase in the metallic oxidation of carbon steels and low alloy steels would result in high metal oxide levels in the slag which is detrimental to refractory life.

If silicon were added to increase the amount available for oxidation, there would be a net heat increase during the refining operation. However, the more silicon that is added to the melt, the more lime must be added to the melt in order to neutralize the silicon oxide in the slag. The addition of the extra lime is endothermic. Hence, the net effect is a small and therefore impractical way of increasing the temperature of the melt.

It is known that the addition of aluminum to the melt will generate heat by its oxidation. Furthermore, the use of aluminum has several advantages over silicon for providing heat to the melt. Aluminum requires less oxygen than silicon per unit of heat released, and it requires less lime than does silicon to form a basic desulfurizing slag. Hence, if one were to substitute aluminum for silicon in the melt, a greater net heat increase could be produced. However, the use of aluminum to generate heat causes refractory problems because when a steel melt (which normally contains carbon, manganese, silicon, chromium, nickel and molybdenum) is blown with an oxygen-rich gas mixture, the oxygen will always react with the aluminum first. Hence, if sufficient aluminum is added to generate enough heat to permit subsequent refining, essentially all of it will be oxidized before any carbon, silicon or other metallics are oxidized, resulting in temperatures exceeding those permitted without causing excessive refractory deterioration. In the case of typical refractory materials used in AOD vessels, the peak temperature permitted is approximately 3140° F.

OBJECTS

It is an object of this invention to provide a method for controlling the temperature of the melt during subsurface pneumatic refining of carbon steel or low alloy steel that will permit the desired tap temperature to be obtained without the need for reblowing and without exceeding those temperatures which cause excessive refractory deterioration.

It is another object of this invention to provide a method for controlling the temperature of the melt during AOD refining of carbon steel or low alloy steel that will permit the desired tap temperature to be obtained without the need for reblowing, and without exceeding those temperatures which cause excessive refractory deterioration.

SUMMARY OF THE INVENTION

The above and other objects, which will be apparent to those skilled in the art, are achieved by the present invention which comprises:

a method for controlling the temperature of the melt during subsurface pneumatic refining of carbon steel or low alloy steel by adding to the melt a fast oxidizing element and a slow oxidizing element before starting the injection of refining oxygen into the melt, the amount of fast oxidizing element added being such that the total amount thereof in the melt is sufficient when oxidized to raise the temperature of the melt to the desired temperature before substantial decarburization begins, and the amount of slow oxidizing element added being such that the total amount thereof in the melt is sufficient when oxidized to maintain the temperature of the melt within the desired temperature range during the decarburization period, whereby the temperature of the melt at the end of the refining period is at least equal to the desired tap temperature.

The desired decarburization temperature is equal to or just below the temperature at or below which refractory wear or deterioration is tolerable and above which it is excessive.

The term "fast oxidizing element" as used in the present specification and claims is meant to include those elements whose oxidation is thermodynamically favored over carbon at steelmaking temperatures, which possess a high heat release per unit of oxygen (that is, greater than 1100 BTU per normal cu. ft. of oxygen), whose oxide is not strongly acidic in conventional steelmaking slags (as silica is, for example) and whose vapor pressure is not substantially greater that that of iron. Aluminum and zirconium illustrative are of fast oxidizing elements. Aluminum is the preferred fast oxidizing element for use in the present invention. Aluminum may be added as aluminum metal or as any iron bearing aluminum alloy.

By use of the term "slow oxidizing element" in the present specification and claims is meant those elements whose oxidation is thermodynamically similar to that of carbon at steelmaking temperatures and at the partial pressures of carbon monoxide experienced during subsurface pneumatic refining, and whose heat released by its oxidation together with that of the oxidation of carbon is substantially equal to the steady state heat losses during the decarburization period. Silicon and vanadium are illustrative of slow oxidizing elements. Silicon is the preferred slow oxidizing element for use in the present invention. Silicon may be added as silicon metal or as ferrosilicon, ferromanganese silicon, ferrochromium silicon or any other ferroalloy bearing silicon compound.

The preferred pneumatic process is the argon-oxygen decarburization (AOD) process.

DRAWINGS

FIG. 1 is a graph illustrating a typical time-temperature curve for a heat of steel made in accordance with the present invention.

DETAILED DESCRIPTION OF THE INVENTION

Figure 1:
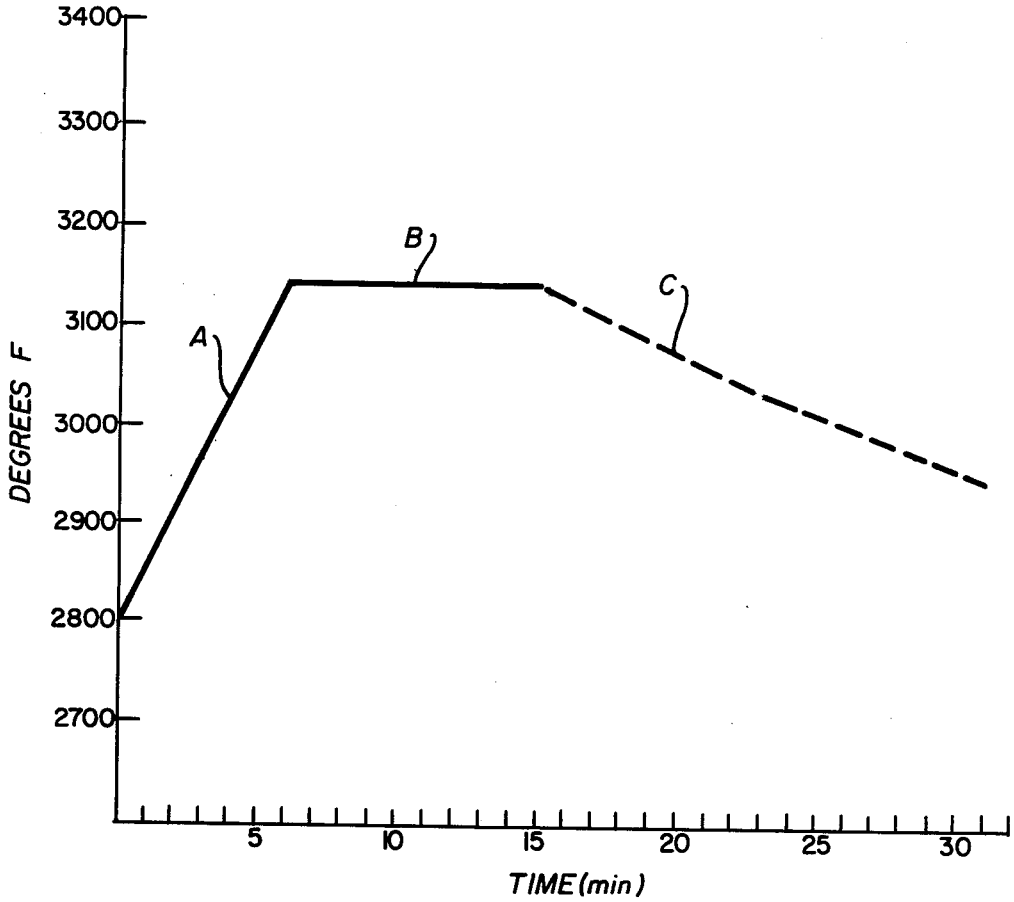

The present invention constitutes the use of a fast oxidizing element in combination with the use of a slow oxidizing element. In the preferred practice of the invention, silicon and aluminum are added before refining begins. It is obvious that silicon and aluminum fuels could also be added during the early stages of the refining oxygen blow. They may be added separately or in combination, and either before or after the molten metal has been charged to the refining vessel. In some cases, one or both of these elements may already be present in the melt. In such cases, additions need to be made to bring the total amount of each element to that required by the present invention. The calculations for determining the amounts of the elements to be added are explained hereinafter.

FIG. 1 illustrates a typical temperature profile of a heat of carbon steel refined in a 5 ton vessel in accordance with the present invention, wherein the carbon level in the melt is reduced 0.40% by the AOD process, utilizing an argon-oxygen ratio of 1:3, with blowing and the total rate of 9600 normal $ft^3$/hr. Under such circumstances, 70 lbs. of aluminum and 30 lbs. of silicon are required to generate the necessary heat in accordance with the present invention. The portion of the curve labeled A shows that if the melt after charging into the refining vessel is 2800° F., it will increase in temperature to approximately 3140° F. in about 6 minutes, during which time the oxidation of the aluminum provides the heat necessary for raising the temperature of the melt to the peak or desired decarburization temperature. The portion of the curve labeled B illustrates the stage of the refining period during which decarburization takes place. That is, the period during which carbon and silicon oxidation, as well as the oxidation of small amounts of metallics, provide heat by oxidizing over a period of about 9 minutes. The final portion of the curve labeled C, which represents the finishing stage of the refining period, takes about 16 minutes. It is the period during which the reduction mix (including lime, if not previously added) alloying elements or other additions to the melt are made. Desulfurization and degassing may also take place during this stage of the refining period. It should be noted that at the end of this time the temperature of the melt is about 2950° F. which is sufficiently high for tapping. Conventional tapping temperatures desired for carbon and low alloy steels range from about 2800° F. to about 3050° F. depending upon the type of steel, as well as the next step in the steelmaking process, which in turn depends on the end use for which the steel is intended as well as shop practice.

In order to obtain the optimum results from practice of the present invention, it is necessary to determine as accurately as possible the quantity of the slow-oxidizing element necessary to maintain peak operating temperature. The quantity of silicon, the preferred slow-oxidizing element, required to maintain temperature during decarburization depends on the amount of carbon to be removed. For example, if, as is common, this quantity of carbon is 0.40–0.60%, it has been found that 0.30% Si will substantially maintain temperature. This quantity is used in the examples to follow. If more carbon is to be removed, this amount of silicon is increased proportionally.

The following exaplanation of the heat-balance calculations will facilitate understanding of the invention, as well as the Examples to follow. For convenience, all of the heat balance terms are calculated as differences in melt temperature.

The following five factors are taken into consideration to calculate the heat input required to make up for the heat lost by the melt:

(1) The heat required to raise the temperature of the melt from its charge temperature to its tap temperature, designated A(°F.)

$$A = T_{tap}\,(°F.) = T_{charge}\,(°F.)$$

(2) The heat required to dissolve the lime, designated B(°F.)

$$B = (\%\ Si) \times 202°\ F./\%\ Si$$

The quantity % Si represents the total percentage by weight of silicon, the silicon charged into the vessel, the silicon added for fuel and the silicon added for reduction. The quantity of silicon charged is adjusted by the silicon added as fuel to be that required as the slow-oxidizing element, for example 0.30% Si for a decarburization of 0.40–0.60%.

The factor 202° F./% Si is derived from metallurgical thermodynamics and the desired slag chemistry. A 1% lime addition will cool a steel bath 47° F. In order to form a basic desulfurizing slag, 4.3% of lime is added for each percent of silicon oxidized.

(3) The heat required to make up for the heat lost during decarburization, designated C(°F.)

$$C = t\ (\text{min.}) \times 12°\ F./\text{min.}$$

Time, t represents the length of the oxygen blow required to oxidize the desired amount of carbon plus that for the silicon fuel plus the expected amount of metallics. This is calculated from the bath chemistry and blow rate. The factor 12° F./min. is determined empirically for the specific vessel considered, here a 5 ton AOD vessel. The empirical determination is made by measuring the temperature of the melt before and after an inert gas blow of measured time at the same total flow rate as during decarburization.

(4) The heat required to make up for the heat lost during inert gas stirring and turn downs D (°F.) is empirically determined for each vessel. This determination is made from previous experience with a specific vessel operating under similar conditions. It is the temperature loss from the beginning of the reduction stir to the end of refining, assuming no other major additions are made.

$$D = 170°\ F.$$

The quantity 170° F. represents the 5 ton AOD vessel used in the examples.

(5) The heat required to dissolve alloy and scrap additions, designated E(°F.)

$$E = (\%\ Z) \times 35°\ F./\%\ \text{additions}$$

The quantity (% Z) represents the percentage of the melt weight added as additions during refining (e.g.

ferromanganese). The factor 35° F./% additions is derived from metallurgical thermodynamics.

Individual cooling effects of various ferroalloy and scrap additions have been calculated (e.g. Fe Ni 32° F./%, HCFeMn 39° F./%, scrap 34° F./%). A representative value for common addition of 35° F./% has been chosen.

The heat supplied by the exothermic oxidations of carbon, silicon and other metallics is calculated as follows:

$$S_C = (\Delta\% C) \times 175° F./\% C$$

where $S_C$ (°F.) is the heat produced by oxidation of the carbon.

The quantity (Δ% C) represents the change in carbon content desired. The factor 175° F./%C is derived from metallurgical thermodynamics and represents the heat released by oxidation of carbon dissolved in the steel bath by gaseous oxygen to carbon monoxide.

$$S_m = (\% M) \times 148° F./\% M$$

where $S_m$ (°F.) is the heat produced by oxidation of the metallics, and %M represents the expected amount of metallics oxidized during the blow which is empirically determined for the grade in question. The factor 148° F./% metallics is derived from metallurgical thermodynamics and represents the average heat released by gaseous oxygen to their most stable metallic oxides by oxidation of Fe, Mn, and Cr.

$$S_{si} = (\% Si) \times 540° F./\% Si$$

where $S_{Si}$ (°F.) represents the heat produced by oxidation of silicon.

The quantity (% Si) represents the combined amount of silicon transferred and added as fuel. This quantity is determined so that it satisfied the criteria of the invention. The factor 540° F./% Si is derived from metallurgical thermodynamics and represents the heat released by oxidation of silicon dissolved in the steel bath by gaseous oxygen to silicon.

The following examples will serve to illustrate the invention.

EXAMPLE 1

A heat of AISI 1025 steel was made by charging 10,200 lb. of molten steel at 2890° F. into a 5 ton AOD vessel. The desired tap temperature is 2950° F. The only non-fuel additions required during the blow are 80 lbs. of high carbon ferromanganese which was added to the melt to meet the manganese specification. It also adds 0.05%C to the bath. The analysis of the charged melt was 0.69%C, 0.12% Si, 0.32% Cr. The aim carbon is 0.20%. Taking into consideration the alloy additions, the Δ% C is 0.45%. Since 0.30% Si as fuel is needed, 25 lbs. of 75% ferrosilicon is added. For this chromium level, 0.25% metallic oxidation is expected. The heat balance, therefore, is calculated as follows:

Heat lost:

$A = T_{tap} - T_{charge} = 2950° F. - 2890° F. = 60° F.$ $B = (\% Si) \times 202° F./\% Si = 0.39\% Si \times 202° F./\% Si = 79° F.$ $C = t (min) \times 12° F./min = 11 min \times 12° F./min = 132° F.$ The figure of 11 minutes is caalculated from the stoichiometric amount of oxygen required to oxidize the carbon, silicon fuel and metallics assuming a 12° F./min steady state heat loss during blowing and an oxygen input rate of 120 normal cubic feet/min.

$D = 170° F.$

The number 170° F. is based on empirical data for this particular vessel as explained before.

$E = (\% Z) \times 36° F./\% Z$ $E = (0.78) \times 35 = 27° F.$

Sum of the heat lost = 468° F.

Heat gained:

| | | |
|---|---|---|
| $S_C = (\Delta\% C) \times 175° F./\% C = 0.45 \times 175$ | = | 79° F. |
| $S_m = (\% M) \times 148° F./\% M = 0.25 \times 148$ | = | 37+ F. |
| $S_{Si} = (\% Si) \times 540° F./\% Si = 0.30 \times 540$ | = | 162° F. |
| Sum of the heat gained | = | 278° F. |

The difference between the sum of the heat lost and the sum of the heat gained is 468° F. − 278° F. = 190° F. of heat loss which needs to be provided by oxidation of aluminum. To obtain the quantity of aluminum which will provide the necessary 190° F. of heat, 190 is divided by 282, which represents the temperature generated when 1% Al is oxidized, taking into account steady state heat loss during the aluminum oxidation period and lime addition required to form a basic slag with the generated alumina. This calculation indicates that 190/282 = 0.72% Al or 73 lbs. should be added.

In order to carry out the process of the invention 73 lbs. of aluminum was added to the vessel to generate the heat to the desired peak temperature range (3100° − 3140° F.), and 25 lbs. of FeSi to maintain this temperature range during decarburization. The desired refined melt was obtained having a tap temperature of 2950° F.

EXAMPLE 2

A 9400 lb. heat of WC6 (ASTM A217-75) was charged to the AOD vessel at 2875° F. The desired tap temperature is 2970° F. The analysis of the charge was: 0.60% C, 0.18% Mn, 0.11% Si, 0.44% Cr, 0.44% Mo. The following additions were made during the blow to bring the analysis into specification: 61 lbs. of high-carbon ferromanganese, 50 lbs. of charge chrome, 8 lbs. of molybdenum oxide. Considering an aim carbon of 0.20% and the alloy additions, the Δ% C is 0.47. Based on this amount, 0.30% Si is needed, hence 17 lbs. of silicon metal is added. For this chromium level, 0.40% metallic oxidation is expected. The heat balance is as follows:

Heat lost:

| | | |
|---|---|---|
| $A = T_{tap} - T_{charge}$ | = | 90° F. |
| $B = (\% Si) \times 202 = 0.44 \times 202$ | = | 89° F. |
| $C = t (min.) \times 12 = 11 \times 12$ | = | 132° F. |
| D = (as in Example 1) | = | 170° F. |
| $E = (\% Z) \times 35 = 1.27 \times 35$ | = | 44° F. |
| Sum of heat lost | = | 530° F. |

Heat gained:

| | | |
|---|---|---|
| $S_C = (\Delta\% C) \times 175 = 0.47 \times 175$ | = | 82° F. |
| $S_m = (\% M) \times 148 = 0.40 \times 148$ | = | 59° F. |
| $S_{Si} = (\% Si) \times 540 = 0.30 \times 540$ | = | 162° F. |
| Sumof heat gained | = | 303° F. |

The difference between the sums of the heat lost and the heat gained is 530° F. − 303° F. = 227° F. Hence, the aluminum required to provide this heat is 277÷282=0.80% Al. This represents the temperature generated when 1% Al is oxidized taking into account steady state heat loss and lime addition. This calculation indicates that 0.80% Al or 75 lbs. should be added. 75 lbs. of aluminum was added to the charge to raise the bath to 3140° F. and 17 lbs. of metallic silicon was added to maintain this temperature during decarburization. The heat which was within specifications was tapped at 2970° F. and hence required no reblowing.

What is claimed is:

1. A method for controlling the temperature of a melt selected from the group consisting of carbon steel and low alloy steel, during subsurface pneumatic refining thereof, comprising adding to said melt before starting the injection of refining oxygen:

(a) a fast oxidizing element characterized by having: its oxidation thermodynamically favored over carbon at steelmaking temperatures, the amount of heat released by its oxidation greater than 1100 BTU/normal $ft^3$ of oxygen, its oxide not strongly acidic in conventional steelmaking slags, and a vapor pressure not substantially greater than that of iron, the amount of said fast oxidizing element added being such that the total amount thereof in the melt is sufficient, when oxidized, to raise the temperature of the melt to the desired temperature before substantial decarburization begins, and (b) a slow oxidizing element characterized: by having its oxidation thermodynamically similar to that of carbon at steelmaking temperatures and at partial pressures of carbon monoxide experienced during subsurface pneumatic refining and by having the amount of heat released by its oxidation together with that of carbon substantially equal to the steady state heat losses during decarburization, the amount of said slow oxidizing element added being such that the total amount thereof in the melt is sufficient, when oxidized, to maintain the temperature of the melt within the desired temperature range during decarburization, whereby the temperature of the melt at the end of the refining period is at least equal to the desired tap temperature.

2. The method of claim 1 wherein the desired decarburization temperature is no greater than the temperature at or below which refractory deterioration is tolerable.

3. The method of claim 1 wherein the subsurface pneumatic refining is carried out by argon-oxygen decarburization of the melt.

4. The method of claim 3 wherein the desired decarburization temperature is approximately 3140° F.

5. The method of claim 3 wherein the tap temperature is in the range of 2800°-3050° F.

6. The method of claim 1 wherein the fast oxidizing element is selected from the group consisting of aluminum metal and an iron bearing aluminum alloy.

7. The method of claim 1 or 6 wherein the slow oxidizing element is selected from the group consisting of silicon metal and a ferroalloy bearing silicon compound.

8. The method of claim 3 wherein the fast oxidizing element is selected from the group consisting of aluminum metal and an iron bearing aluminum alloy.

9. The method of claim 3 or 8 wherein the slow oxidizing element is selected from the group consisting of silicon metal and a ferroalloy bearing silicon compound.

* * * * *

UNITED STATES PATENT AND TRADEMARK OFFICE

CERTIFICATE OF CORRECTION

PATENT NO. : 4,187,102

DATED : February 5, 1980

INVENTOR(S) : R.J. Choulet et al

It is certified that error appears in the above-identified patent and that said Letters Patent are hereby corrected as shown below:

In col. 1, line 8, "surface" should read -- subsurface --.

In col. 1, line 25, after "steam" insert -- carbon monoxide --.

In col. 4, line 47, "illustrative are" should read -- are illustrative --.

In col. 6, line 4, "exaplanation" should read -- explanation --.

In col. 7, line 52, "arbon" should read -- carbon --.

In col. 7, line 53, "mel ," should read -- melt to --.

In col. 7, line 54, the percent carbon should read -- 0.05% C --.

In col. 7, line 55, "0.69% C" should read -- 0.60% C --.

UNITED STATES PATENT AND TRADEMARK OFFICE

CERTIFICATE OF CORRECTION

PATENT NO. : 4,187,102

DATED : February 5, 1980

INVENTOR(S) : R.J. Choulet et al

It is certified that error appears in the above-identified patent and that said Letters Patent are hereby corrected as shown below:

In col. 7, line 66, "caalculated" should read -- calculated --.

In col. 8, line 6, "36°F" should read -- 35°F --.

In col. 8, line 12, "37+F" should read -- 37°F --.

In col. 8, line 65, "Sumof" should read -- Sum of --.

Signed and Sealed this

*Seventeenth* Day of *June 1980*

[SEAL]

*Attest:*

*Attesting Officer*

SIDNEY A. DIAMOND

*Commissioner of Patents and Trademarks*